US005348642A

United States Patent [19]

Serrand et al.

[11] Patent Number: 5,348,642

[45] Date of Patent: Sep. 20, 1994

[54] CATALYTIC CRACKING PROCESS WITH CIRCULATION OF HOT, REGENERATED CATALYST TO THE STRIPPING ZONE

[75] Inventors: Willibald Serrand, Buxheim, Fed. Rep. of Germany; Philip Holmes, West Horsley, United Kingdom; Todd R. Steffens, Randolph; Patrick H. Terry, Middletown, both of N.J.; Paul E. Eberly, Baton Rouge, La.

[73] Assignee: Exxon Research Engineering Co., Florham Park, N.J.

[21] Appl. No.: 16,398

[22] Filed: Feb. 11, 1993

Related U.S. Application Data

[63] Continuation-in-part of Ser. No. 694,737, May 2, 1991, abandoned.

[51] Int. Cl.[5] ..... C10G 11/00

[52] U.S. Cl. ..... 208/113; 208/78; 208/80; 208/150

[58] Field of Search ..... 208/78, 80, 113, 150

[56] References Cited

U.S. PATENT DOCUMENTS

| | | | |
|---|---|---|---|
| 2,451,619 | 10/1948 | Hengstebeck et al. | 196/52 |
| 3,630,886 | 12/1971 | Deed et al. | 208/78 |
| 3,714,024 | 1/1973 | Youngblood et al. | 208/80 |
| 3,751,359 | 8/1973 | Bunn | 208/113 |
| 3,993,556 | 11/1976 | Reynolds et al. | 208/80 |
| 4,541,923 | 9/1985 | Lomas et al. | 208/113 |
| 4,789,458 | 12/1988 | Haddad et al. | 208/151 |
| 4,971,681 | 11/1990 | Harandi et al. | 208/150 |
| 4,976,847 | 12/1990 | Maxwell et al. | 208/120 |
| 5,000,841 | 3/1991 | Owen | 208/150 |
| 5,062,945 | 11/1991 | Pappal et al. | 208/150 |

*Primary Examiner*—Helane Myers
*Assistant Examiner*—Walter D. Griffin
*Attorney, Agent, or Firm*—Roy J. Oh

[57] ABSTRACT

A catalytic cracking process and apparatus wherein particles of cracking catalyst circulate continuously between a reaction zone and a regeneration zone and hot regenerated catalyst from the regeneration zone contacts hydrocarbon feed in the reaction zone to produce cracked hydrocarbon products and spent catalyst. The spent catalyst is recovered and subjected to stripping in a stripping zone to remove strippable material therefrom. The stripped spent catalyst is circulated to the regeneration zone for oxidative exothermic regeneration. Some hot regenerated catalyst is passed directly from the regenerator to the stripping zone via a conduit provided for this purpose. Another hydrocarbon stream is passed into contact with the hot regenerated catalyst in this conduit. The said other hydrocarbon stream is converted to products of enhanced value (e.g., olefins) during contact with catalyst in the conduit, and the said products are recovered. The heat for the conversion is abstracted from the catalyst particles passing via the pipe to the stripping zone. The hot catalyst particles entering the stripping zone from the pipe increase the temperature in the stripping zone, thereby improving the stripping in the stripping zone.

8 Claims, 4 Drawing Sheets

Cracking of isobutane at 19.2 Cat/Oil
Equilibrium Catalyst

CATALYTIC CRACKING PROCESS WITH CIRCULATION OF HOT, REGENERATED CATALYST TO THE STRIPPING ZONE

CROSS-REFERENCE TO RELATED APPLICATIONS

This application is a continuation-in-part application of application Ser. No. 694,737, filed May 2, 1991 now abandoned.

BACKGROUND OF THE INVENTION

2. Field of the Invention

The present invention relates to a catalytic cracking process and apparatus, particularly a fluid catalytic cracking unit ("FCCU").

2. Description of the Prior Art

In contemporary catalytic cracking processes, the feedstock is contacted with particles of hot, active cracking catalyst at a suitably elevated temperature whereby the feedstock is at least partly converted to vaporous cracked products in endothermic reactions. The products are separated from the resultingly cooled used catalyst and recovered, and the cooled used catalyst is separately recovered. The used catalyst is associated with hydrocarbon material which is disposed in the spaces between catalyst particles and also adsorbed in and on the surfaces and pores of the particles. The used catalyst particles and associated hydrocarbon material are subjected to a stripping process to remove from the particles as much hydrocarbon material as is technically and economically possible, the thus-removed hydrocarbon material is recovered. The stripped particles and remaining associated hydrocarbon materials are passed to a regenerator wherein the remaining associated hydrocarbon materials are removed from catalyst particles by oxidation with an oxygen-containing gas. The oxidation reactions are strongly exothermic and the resulting regenerated catalyst particles of substantially reduced hydrocarbon material content are thereby heated to an elevated temperature at which they can be used for contacting further quantities of feedstock.

There are technical and commercial incentives to ensure that the stripping process is as effective as possible. From the technical viewpoint, the oxygen-requirement for the regeneration step is increased for increases in the amount of hydrocarbon material associated with catalyst material undergoing regeneration. The amount of oxygen-containing gas required for regeneration determines the size of the regeneration equipment, including the blower for the oxygen-containing gas, the regenerator vessel, the gas ducting, and regenerator overhead gas treatment facilities, and thereby the capital cost of the foregoing. Moreover, an increase in oxygen requirement necessitates the use of a higher-capacity blower which, in turn, requires more power for its operation, thereby adding to the increased costs of the plant. Furthermore, the oxidation of relatively large amounts of hydrocarbon material generates heat which, if excessive, can damage the catalyst particles and also the regenerator equipment.

From the commercial viewpoint, the oxidation of hydrocarbon material in the regenerator represents a loss of hydrocarbon material which might otherwise add to the products obtained in the catalytic cracking process. Furthermore, for existing FCCU of limited coke burning capacity, a reduction in strippable hydrocarbon entering the regenerator would permit an increase in other coke-making factors e.g. reactor intensity, feed rate or feed quality, hence increasing FCCU profitability.

There are therefore incentives to separate from used catalyst particles as much hydrocarbon material as possible. Such separation is often designated "stripping" and will be so referred to herein, from time-to-time.

One way in which the effectiveness of stripping can be enhanced is by raising the temperature at which the stripping is performed.

U.S. Pat. No. 4,789,458 discloses a typical fluid catalytic cracking process with the added concept of recirculation of hot regenerated catalyst to heat the spent catalyst in the stripping zone to thereby improve stripping of hydrocarbon volatiles on the spent catalyst. This patent does not disclose contacting the hot regenerated catalyst stream with a hydrocarbon stream prior to entering the stripping zone.

U.S. Pat. No. 2,451,619 also discloses the broad concept of using regenerated catalyst particles to heat spent catalyst in the stripping zone. This patent discloses that the hot regenerated catalyst to be introduced into the stripping chamber may be maintained in an aerated liquid-like condition by means of aeration gas introduced with the regenerated catalyst circulated to the stripping zone. Aeration gas may be steam or an inert gas or it may be a hydrocarbon gas. In the event a hydrocarbon gas is used as the aeration gas its purpose is to affect the displacement of any oxygen containing gases by burning the remaining oxygen.

SUMMARY OF THE INVENTION

In a catalytic cracking process comprising contacting a hydrocarbon feedstock in a reactor with particles of hot regenerated cracking catalyst under fluid catalytic cracking conditions to form vaporous cracking products and used catalyst particles having hydrocarbonaceous material and coke deposited thereon; stripping the used catalyst particles with a stripping fluid in a stripping zone to remove some hydrocarbonaceous material therefrom; recovering stripped hydrocarbonaceous material from the stripping zone and circulating stripped used catalyst particles to a regeneration zone; contacting stripped used catalyst particles in the regeneration zone with an oxygen-containing gas to remove unstripped hydrocarbonaceous material and coke therefrom by oxidation thereby raising the temperature of the catalyst particles; and circulating hot regenerated catalyst particles to the reactor for contact with further amounts of hydrocarbon feedstock; the improvement which comprises (a) separately circulating hot regenerated catalyst particles from the regenerator into the stripping zone whereby the hot regenerated particles mix with and raise the temperature of used catalyst particles in the stripping zone, (b) passing into contact with the separately circulating hot regenerated catalyst particles in step (a) a hydrocarbon-containing stream, said hydrocarbon-containing stream being contacted with the separately circulating hot regenerated particles before they enter the stripping zone and said hydrocarbon-containing stream containing an amount of hydrocarbon in excess of that required to effect aeration of the separately circulating hot regenerated catalyst and to combust all the oxygen present therewith so that the hydrocarbons are catalytically and thermally cracked into more desirable products and (c) recovering the cracked hydrocarbon products produced in step (b).

In a further embodiment of the invention, the hydrocarbon containing stream of step (b) above comprises a $C_4$ to $C_5$ olefin in combination with a hydrocarbon selected from the group consisting of alkanes, cycloalkanes, cycloalkenes, alkylaromatics and mixtures thereof.

The invention further includes passing a catalyst-conditioning gas into contact with the separately-circulating particles in step (a) above before the separately-circulating particles are contacted with the hydrocarbon-containing stream, said catalyst conditioning stream containing a catalyst-conditioning agent selected from the group consisting of hydrogen, steam, methane, ammonia, nitrogen, an aromatic-containing stream, an amine-containing stream and a combination of at least two of the foregoing.

In another embodiment of the catalytic cracking process of the invention, the improvement comprises (a) separately circulating hot regenerated catalyst particles from the regenerator into the stripping zone whereby the hot regenerated particles mix with and raise the temperature of used catalyst particles in the stripping zone, (b) passing into contact with the separately circulating hot regenerated catalyst particles in step (a) a hydrocarbon-containing stream, said hydrocarbon-containing stream being contacted with the separately circulating hot regenerated particles before they enter the stripping zone and said hydrocarbon-containing stream containing an amount of hydrocarbon in excess of that required to effect aeration of the separately circulating hot regenerated catalyst and to combust all the oxygen present therewith so that the hydrocarbons are catalytically and thermally cracked into more desirable products and (c) separating the cracked hydrocarbon products from the regenerated catalyst particles passing to the stripper before the regenerated particles enter the stripper.

The rate at which hot regenerated catalyst particles pass to the stripping zone may increase the average catalyst temperature in the stripping zone by up to 40° C. compared to the stripping zone temperature when no hot regenerated catalyst particles are passed thereinto.

The rate at which hot regenerated catalyst particles pass to the stripping zone, and the extent to which these particles have taken part in heating, vaporizing and cracking the said other hydrocarbon-containing stream influences the average catalyst temperatures in the stripping zone of the FCCU. For example, when 100% of the normal hot regenerated catalyst circulating rate is employed, the average catalyst temperature in the stripping zone may be increased by up to 110° C. (relative to the case where the catalyst circulation rate is zero). When the catalyst circulating rate is 1% or (more preferably) 15% of the normal hot regenerated catalyst circulation rate, the average stripping zone catalyst temperature is increased by up to 2° C. or up to 30° C., respectively.

A paraffins-dehydrogenation component may be incorporated in or with the cracking catalyst to promote or enhance the dehydrogenation of paraffinic hydrocarbons in the said hydrocarbon-containing stream.

The paraffins-dehydrogenation component may be selected from (inter alia) metals of group 8A of the periodic table of elements as published by Sargent-Welch, Scientific Company 1979. The process of the present invention may be advantageously employed to convert a hydrocarbon feed having a relatively high content of nickel; such a feed might be, or comprise, atmospheric and/or vacuum residua. Such feeds deposit nickel on the catalyst particles until an equilibrium level of nickel-on-catalyst is attained (due to the balance of nickel-accumulation from the feed and nickel losses with catalyst lost or removed from circulation in the process) which is relatively significant or high, e.g. exceeding 1000 wppm Ni. The activity of nickel deposited on the cracking catalyst may be enhanced by withholding the application to circulating catalyst of passivation agents such as antimony or bismuth compounds. Further benefits can be attained by providing CO-combustion promoters (such as platinum moieties) in association with cracking catalyst. A suitable smallpore zeolite may be incorporated in particles circulated with the hydrocarbon-cracking catalyst particles in place of or in addition to the said in situ or additive paraffins dehydrogenation agents (such as the said metal(s) from group 8A).

Heat for the strongly endothermic paraffin dehydrogenation reaction is directly provided from the combustion of coke in the regenerator by the hot circulating catalyst. The resulting reduced regenerator temperature may require additional feed preheating to maintain the FCCU reactor temperature.

In another aspect, the present invention provides fluidized catalytic cracking unit ("FCCU") comprising:

(a) a reactor wherein a hydrocarbon feedstock is contacted with particles of hot regenerated catalyst;

(b) a separator for separately recovering vaporous cracked products in a product-recovery region and used catalyst from the reactor in a catalyst-recovery region;

(c) a stripping zone connected for receiving used catalyst from the catalyst-recovery region;

(d) means for passing a stripping fluid into the stripping zone to strip hydrocarbonaceous material from used catalyst particles;

(e) a regenerator connected for receiving stripped used catalyst particles from the stripper;

(f) means for passing an oxygen-containing gas into contact with a fluidized bed of catalyst particles in the regenerator to remove hydrocarbonaceous material therefrom by exothermic oxidation which raises the temperature of the particles;

(g) first conduit means for circulating hot regenerated catalyst particles from the regenerator to the reactor;

(h) second conduit means for separately circulating hot regenerated particles from the regenerator to the stripping zone, and (i) means for passing a hydrocarbon-containing stream into contact with hot regenerated particles in the second conduit means at one or more regions of the second conduit means between the regenerator and the stripper.

The unit may comprise a separator in the second conduit means between the regenerator and the stripping zone, said separator being operative for the separation of at least part of the hydrocarbon-containing stream and conversion products thereof from hot regenerated particles passing via the second conduit means to the stripping zone.

The unit may also comprise means for passing a catalyst-conditioning gas and/or vapor stream into contact with hot regenerated catalyst particles in the second conduit means at one or more regions of the second conduit means between the regenerator and the region(s) at which the said hydrocarbon-containing stream is passed into the second conduit means.

BRIEF DESCRIPTION OF THE DRAWINGS

In the drawings, like parts are given like reference numbers. The drawings show only those features and parts of the respective FCCUs which are necessary for their understanding by a person skilled in the art.

DETAILED DESCRIPTION OF THE INVENTION

Figure 1:
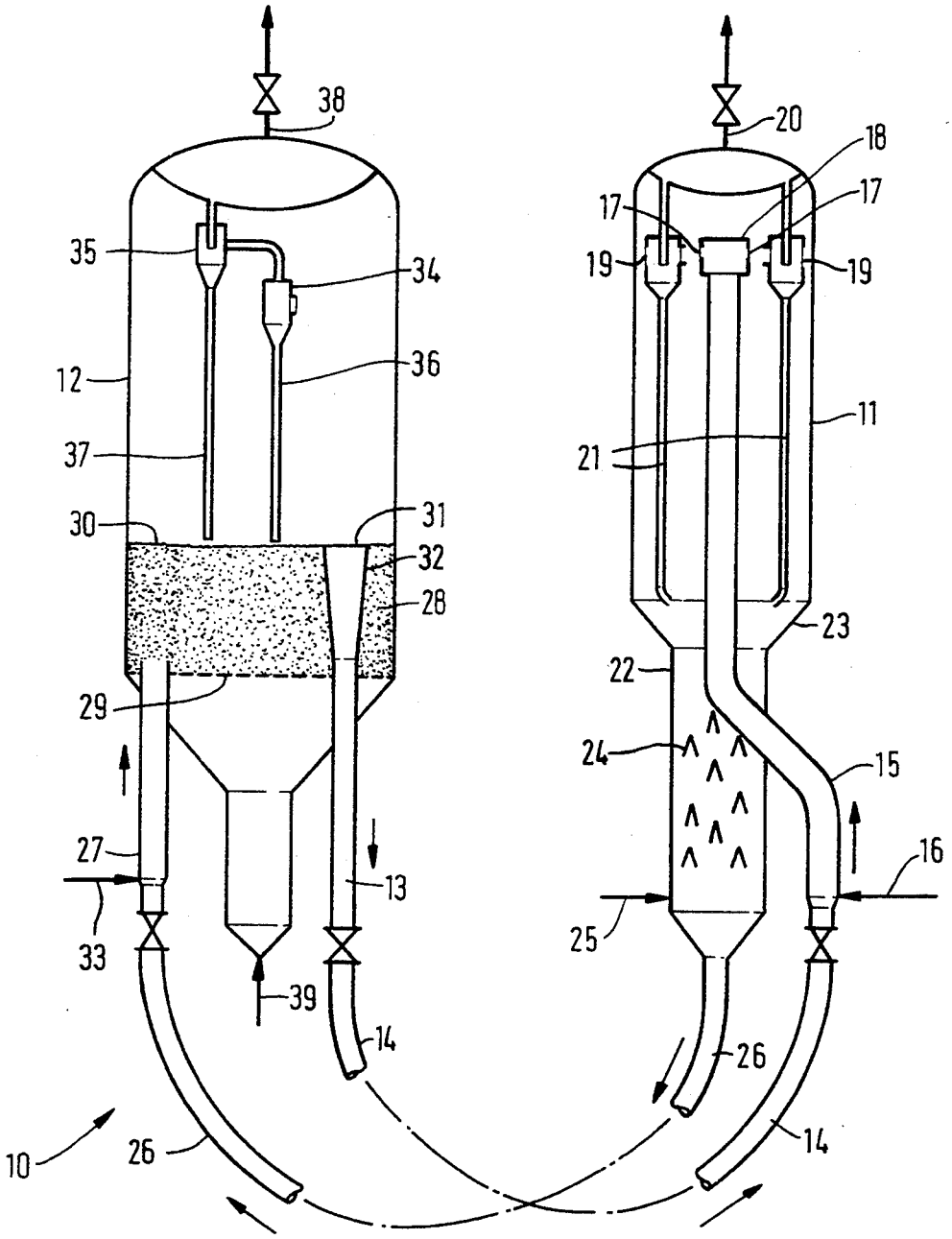
FIG. 1 shows, schematically, the principal parts of a known type of fluidized catalytic cracking unit ("FCCU")

Reference is first made to FIG. 1 wherein the FCCU, generally indicated by 10, comprises a reactor vessel 11 and a regenerator vessel 12.

Hot regenerated particles of cracking catalyst are recovered from the regenerator vessel 12 in a downcomer 13 which is connected at its bottom end to the top of one upstanding are of a U-shaped conduit 14, the top of the other arm of which is connected to a riser 15. The riser 15 is a generally vertical tube which may have, as is shown in FIG. 1, an inclined section so that the part of the riser 15 surmounting the inclined section lies within the reactor 11.

The hydrocarbon feed which is to be cracked is passed from a feed line 16 into the interior of the bottom end of the riser 15 via one or more injectors (not shown) so as to furnish good dispersion of the feed with the hot regenerated catalyst particles.

The contacting of the feed with the hot regenerated catalyst results in the generation of hydrocarbon vapors which reduce the density of the catalyst/hydrocarbon mixture in the riser 15 to a lower density than the catalyst density in the downcomer 13, and as a result of the difference in weight between the catalyst masses in the downcomer 13 and the riser 15, a circulation of catalyst from the downcomer 13 to the riser 15 through the conduit 14 is promoted and maintained. The catalyst flow may be assisted by the injection of a fluidizing gas, usually steam, at suitable injection points (not shown) along the length of the conduit 14 in a manner which is well-known to those skilled in the art.

The mixture of catalyst and cracked hydrocarbon products discharges from the top of the riser 15, within the reactor vessel 11, via substantially horizontal orifices 17 below a cap 18 at the top end of the riser 15 into one or more cyclone separators 19 wherein entrained used catalyst particles are separated, and substantially solids-free vapor-phase cracked products are recovered via product line 20. Used catalyst particles which are separated by the cyclone(s) 19 pass to the bottom of the reactor vessel via diplet 21.

The used catalyst particles which accumulate at the bottom of the reactor vessel are associated in various ways with hydrocarbon materials. Some of the associated hydrocarbon materials are entrained between used catalyst particles, and some associated hydrocarbon material is sorbed on or in the used catalyst particles. Since the hydrocarbon materials thus associated can represent an appreciable proportion of the total hydrocarbon feed input, it is common practice to subject the used catalyst particles to a hydrocarbon-stripping operation to remove hydrocarbon materials therefrom.

The stripping operation is performed in a stripper 22. The stripper 22 comprises a generally cylindrical vessel having its top end open to the frusto-conical bottom end 23 of the reactor vessel 11 so that catalyst particles are received in the stripper 22 from the reactor vessel.

Within the stripper 22 are mounted baffle devices, which in this embodiment take the form of arrays of metal "sheds" 24 which resemble the pitched roofs of houses. The purpose of the sheds 24 is to disperse falling catalyst particles uniformly across the width of the stripper 22 and to reduce or prevent recycling of catalyst particles within the stripper 22.

A stripping fluid, usually steam, is passed into the bottom region of the stripper 22 from a suitable pipe 25, and the steam passes upwardly in counterflow to the downflowing catalyst particles, thereby separating therefrom hydrocarbon materials which are entrained between the particles and also desorbing some of the sorbed hydrocarbon material.

Steam and separated hydrocarbon material pass into the reactor vessel and cyclone separator(s) 19, and are recovered in the product line 20.

Stripped catalyst particles are recovered from the frustoconical bottom of the stripper 22 in an upright arm of a U-shaped conduit 26 which is generally similar to the U-shaped conduit 14. The other upright arm 27 of the conduit 26 terminates at its open upper end in a bed 28 of catalyst undergoing regeneration. The bed is supported on a gas distributor 29 and extends upwardly to a level 30 which is determined, at least in part, by the level of the top of an exit weir 31 formed by the top of a funnel 32 which is connected at its bottom to the top of the downcomer 13.

A fluidizing gas, such as air, is passed into the bottom region of the upright arm 27 from a gas line 33 to fluidize and reduce the density of catalyst in the arm 27 so that the weight of catalyst in the opposite arm of conduit 26 causes catalyst to flow through conduit 26 into the bed 28.

Catalyst in the bed 28 is regenerated by passing air or other oxygen-containing gas into the bottom of the bed 28 via perforations in the distributor 29. The air is passed from air conduit 39 into the bed 28 via the distributor 29.

Combustible hydrocarbonaceous material ("coke") on the used, stripped catalyst particles in the bed 28 is at least partly removed by exothermic oxidation in the bed 28 whereby the regenerated catalyst particles overflowing the weir 31 for return to the riser 16 have a raised temperature compared to the temperature of the used stripped catalyst particles entering the bed via riser 27 from the stripper. The raised temperature of the regenerated catalyst particles represents added heat which is useful for the endothermic vaporization and cracking of the hydrocarbon feed introduced from feed line 16.

Spent regeneration gas and entrained catalyst leave the top of the bed 28 and pass via a primary cyclone separator 34 and a secondary cyclone separator 35 before being recovered in flue gas line 38 for disposal. Entrained catalyst particles which are separated by the cyclones 34 and 35 are returned to the bed 28 by respective diplegs 36 and 37.

Figure 2:
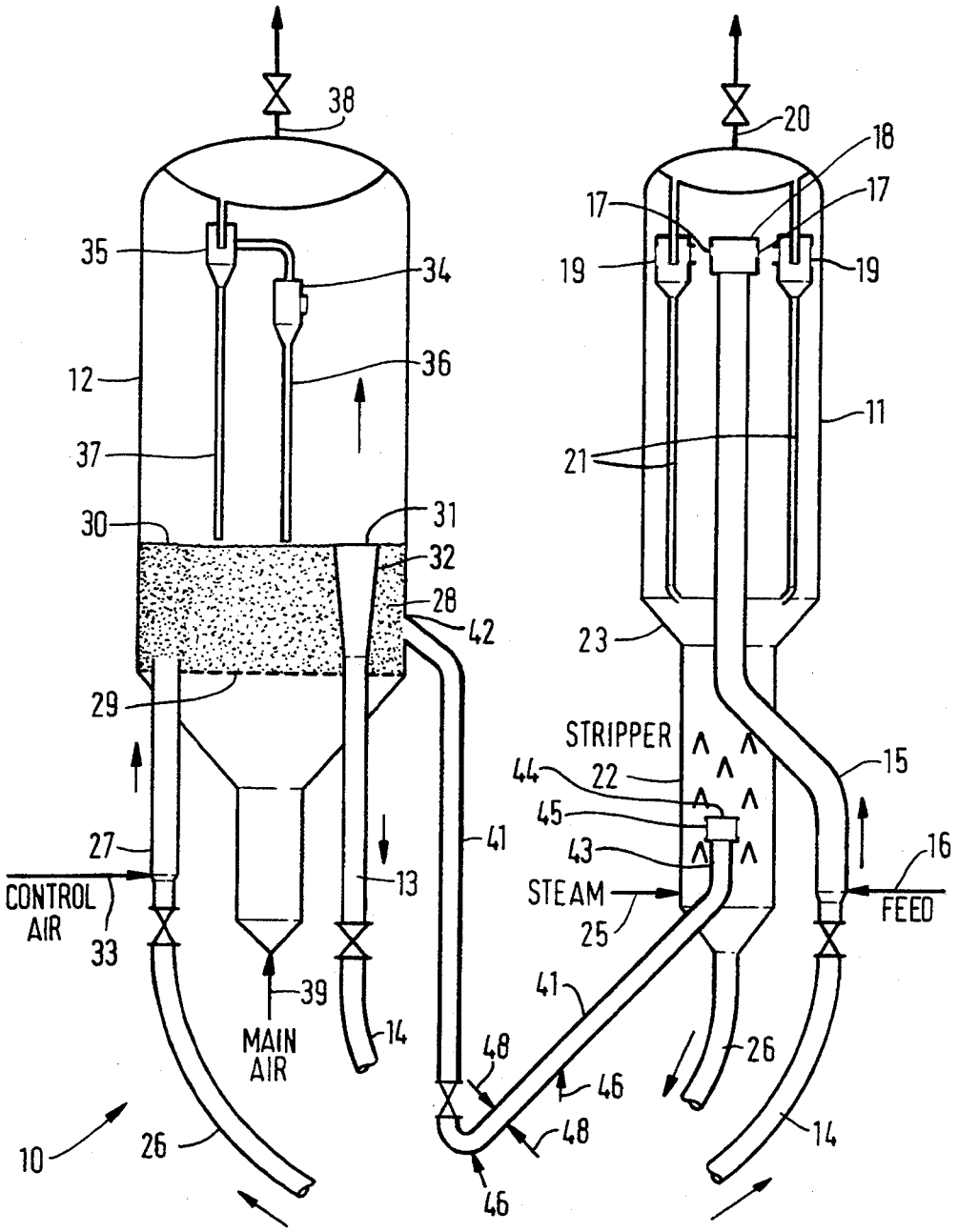
FIG. 2 shows the principal parts of one type of embodiment of an FCCU in accordance with the invention.

Reference is now made to the diagrammatic drawing of FIG. 2. The embodiment in FIG. 2 may be regarded as a modification or adaption of the FIG. 1 embodiment. Accordingly, in the description of FIG. 2 which follows, reference will be made mainly to the features by which FIG. 2 differs from FIG. 1, without mention (except where necessary) of the features common to both embodiments.

The FIG. 2 embodiment is provided with a transfer-line 41 which is connected at one end region 42 to the regenerator bed 28, to receive hot regenerated catalyst, and connected at the other end region 43 to the stripper 22 for the introduction into the stripper of hot regenerated catalyst.

As depicted, the transfer-line has the configuration of a 'J', but other configurations may be used (as will be appreciated and understood by those skilled in the art) according to (e.g.) the physical arrangement of the regenerator 12 and stripper 22.

A fluidizing gas (e.g. steam, hydrogen, methane, ammonia, nitrogen, an aromatic-containing stream, an amine-containing stream or any combination thereof) may be passed into the upsloping part of the transfer-line 41 connected into the stripper 22 to reduce the density of catalyst particles therein so that the weight of catalyst particles therein is less than the catalyst particles' weight in the downsloping part whereby catalyst particles circulate through the transfer-line 41 from the regenerator end (at region 42) to the stripper end (at region 43). Fluidizing gas for this purpose is passed into transfer-line 41, e.g. from pipes 46. The region 43 of the transfer-line 41 terminates in a cap 44 which surmounts horizontally directed orifices 45 through which hot regenerated catalyst particles enter the interior of the stripper 22 and mix with used catalyst particles undergoing stripping therein.

The termination of the transfer-line 41 within the stripper 22 is preferably arranged to provide good dispersion of the hot regenerated catalyst within the catalyst undergoing stripping in the stripper 22. Preferably the hot regenerated catalyst particles are dispersed into the upper half of the total depth of the fluidized bed (not shown) of catalyst particles within the stripper. In embodiments wherein a sparge gas or vapor (e.g. steam) is passed into the stripper above the top level of the fluidized bed therein to promote the removal of stripped hydrocarbon material from the stripper 22 into the product recovery line 20, at least some of the hot regenerated catalyst particles could enter the stripper 22 from the transfer-line 41 in the top region of the dense phased fluidized bed therein. The manner of providing this sparge gas or vapor will be obvious to those skilled in the art.

The temperature and amount of the hot regenerated catalyst particles entering the stripper may be such that the average temperature of catalyst in the stripper is raised by up to 110° C. with a hot regenerated catalyst stream which circulates via transfer-line 41 at 100% of the normal catalyst circulation rate via conduit 26. When the catalyst circulation rate via transfer line 41 is about 1% of the normal catalyst circulation rate via conduit 26, the average temperature of catalyst in the stripper is raised by up to 2° C. or thereabouts, and when the catalyst circulation rate via the transfer-line 41 is about 15% of the normal catalyst circulation rate via conduit 26, the average catalyst temperature in the stripper is raised by up to 30° C. Such a rise in temperature promotes and facilitates the removal of significant amounts of hydrocarbon material associated with used catalyst particles and which would otherwise pass to the regenerator, usually in the form of "coke". Investigations employing commercial used catalyst particles indicate that a "coke" reduction of 5 wt. % is possible for an increase of 30° C. in the temperature of catalyst in the stripper, which temperature rise is caused by the addition of hot regenerated catalyst from the regenerator. Such a 5 wt. % coke reduction is realized despite the potential of the added hot regenerated catalyst particles for adsorbing and/or re-adsorbing stripped hydrocarbon material. The thus-removed hydrocarbon material is recovered as useful or potentially useful product with the vaporous products in line 20. The resulting catalyst particles passing to the regenerator 12 via conduit 26 from the stripper 22 are depleted in hydrocarbon material compared to the hydrocarbon material which would otherwise be associated therewith were the used catalyst to be stripped in the stripper without the addition thereto of hot regenerated catalyst. Accordingly, the amount of oxygen required to burn off hydrocarbon material from the catalyst in the regenerator is reduced, and since the carbon-burning capability of the regenerator and associated components (such as the blower, not shown, for supplying oxygen-containing gas to the regenerator via line 39) is often the limiting factor on the operation of a FCCU, the addition of hot regenerated catalyst to the stripper 22 increases the capacity of the FCCU for the conversion of feed (e.g. in terms of catalytic carbon and/or Conradson carbon and/or catalyst-contaminating metals added in or with the hydrocarbon feedstock) to maintain the amount of coke or unstripped hydrocarbon material on the stripped catalyst particles at levels which can be adequately removed in the regenerator 12 without modification of the regenerator. This allows for an increase in hydrocarbon conversion in the FCCU at constant feed-rate, or an increase in feed-rate at constant conversion, or the conversion in the FCCU of poorer quality feed at unchanged or approximately unchanged conversion; each of the foregoing options increases the operating profitability of the FCCU. If the FCCU should not be operating at a carbon-burning limit (imposed by the capabilities of the regenerator and its associated ancillary equipment) because less hydrocarbon material passes to the regenerator, temperatures in the regenerator bed are reduced thereby reducing the temperature of hot regenerated catalyst passing to the riser 15 from the regenerator whereby the degree of thermal cracking (as opposed to catalytic cracking) of the feed is reduced and the yield of upgraded catalytically cracked products recovered in line 20 is concomitantly increased.

The beneficial effects of mixing hot regenerated catalyst with used catalyst in the stripper are further enhanced by treating the hot regenerated catalyst with a hydrocarbon feedstock before the catalyst is introduced into the stripper 22. In the FIG. 2 embodiment, a stream of hydrocarbon is introduced into contact with hot regenerated catalyst in the transfer-line 41 at one or more locations thereof, preferably near the lower end of the upsloping section. Hydrocarbon introduction injectors 48 are indicated at a typical location of the transfer-line 41. The hydrocarbon which is introduced via the injectors 48 may be a single hydrocarbon or a mixture of hydrocarbons, and the hydrocarbon(s) may be introduced in a dispersed or diluted form in or with a suitable carrier gas such as steam and/or hydrogen and/or methane and/or ammonia and/or nitrogen, and/or an aromatic-containing stream and/or an amine-containing stream.

The hydrocarbon may be selected from alkanes from (i) gaseous or liquefied petroleum gas streams (e.g., ethane, propane, n-butane, iso-butane); (ii) virgin, catalytically or thermally cracked naphthas (e.g., $C_4$ to $C_{12}$); (iii) refinery paraffin or aromatic extraction processes (e.g., $C_4$ to $C_{20}$ and higher); (iv) hydrocarbon synthesis processes (e.g., Fischer-Tropsch reaction products); (v) lubricating oil processing units (e.g., slack waxes from processed vacuum gas oils or atmospheric or vacuum residues; (vi) hydrotreating processes; (vii) so-called "pristine feeds", by which is meant high-quality, relatively easily-crackable, low coke-generating feeds; and (viii) any feasible combination of one or more of (i) to (vii).

The hydrocarbons in the said other hydrocarbon-containing stream may be selected from alkanes, cycloalkanes, alkenes, cycloalkenes and alkyl-aromatics from one or more of the said streams (i) to (viii). In particular (but not exclusively), the appropriate or suitable components of the said other hydrocarbon-containing stream may be or include $C_4$ and $C_5$ olefins such as 1-butene, cis-2-butene, trans-2-butene and various amylenes, either alone or in combination.

The foregoing is not intended to be an exhaustive definition of the hydrocarbons which can be employed.

On contacting hot regenerated catalyst particles, the hydrocarbons are catalytically and thermally cracked into more desirable and valuable products which pass along the conduit 41 and enter the catalyst bed in the stripper 22. These stripped products are recovered with the FCCU reactor products in line 20.

Coke tends to be formed during the reactions which occur when the hydrocarbons contact the hot regenerated catalyst, but the amount of coke thus formed is offset by the coke reduction achieved by operating the stripper at an increased operating temperature.

The dehydrogenation of paraffins is a strongly endothermic reaction (heat of reaction is 23 kcal/g.mol for the conversion of isobutane to isobutene at 650° C.). This heat is directly provided from the combustion of coke in the regenerator by the hot circulating catalyst and any additional feed preheat to maintain the FCCU reactor temperature. However, this can be a very attractive means of removing excess regenerator heat for those FCCUs processing poor gravity feeds with limited coke burning capacity. It can avoid the operating debits of higher catalyst costs or lost conversion, or investment in catalyst cooling facilities raising additional steam.

The catalyst material circulating in the FCCU may include at least one component which promotes cracking of the hydrocarbons added via the injectors 48. The component may be a dehydrogenation-promoting metal such as nickel which is derived from the hydrocarbon feed introduced via feedline 16 or it may be any other dehydrogenation component which is added to the circulating catalyst and which is compatible therewith without detracting to an unacceptable extent from the cracking properties of the catalyst. The added dehydrogenation component may be a catalyst containing a small pore zeolite such as one of zeolites 3A or 5A or ZSM-5-containing metals of Group 8 and/or other dehydrogenation enhancing metals, or a catalyst comprising a dehydrogenation enhancing metal on an alumina support.

The gases and vapors entering the stripper 22 from the transfer-line 41 enhance the stripping of hydrocarbon material from used catalyst in the stripper, and stripped hydrocarbon materials together with olefins and other vapors and gases from the transfer-line 41 are recovered in product line 20 in combination with other catalytically cracked vaporous material from the riser 15 and the reactor vessel 11.

Figure 3:
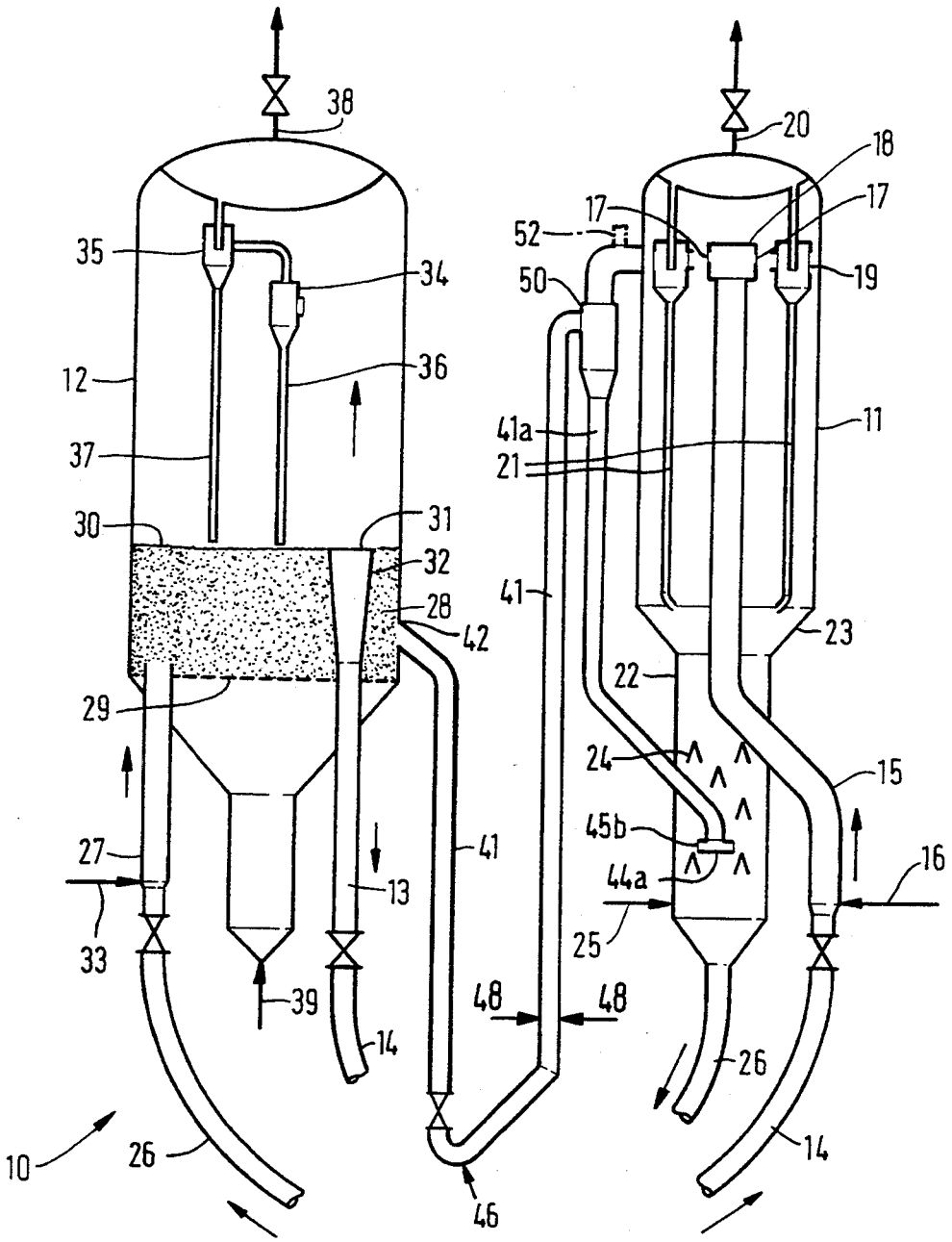
FIG. 3 shows the principal features of another type of embodiment of a FCCU in accordance with the invention.

Reference is now made to the diagrammatic drawing of FIG. 3. The embodiment of FIG. 3 can be regarded as a modification of the embodiment of FIG. 2, but differing therefrom principally by the provision of means of recovering converted (e.g., dehydrogenated and/or cracked) hydrocarbons and other products from the transfer-line 41 before the hot regenerated catalyst therein is introduced into the stripper 22.

In the FIG. 3 embodiment, the transfer-line 41 is provided with a cyclone separator system comprising at least one cyclone separator 50 which receives hot regenerated catalyst and converted hydrocarbons from the transfer-line 41 at a location downstream of the point(s) 48 of introduction of the hydrocarbon into the transfer-line 41.

The cyclone separator 50 separates hot regenerated catalyst from the vaporous materials associated therewith in the transfer-line 41 and separated hot regenerated catalyst particles pass down transfer-line dipleg **41*a* into the stripper 22 wherein they are dispersed into the upper part of the fluidized bed of used catalyst particles therein by a termination cap 44*a* beneath horizontally-discharging orifices 45*a*** where they mix with and raise the temperature of used catalyst particles undergoing stripping with the beneficial effects already disclosed herein.

The vaporous products in the transfer-line 41 which are separated from catalyst particles by cyclone separator 50 (which may or may not be located within the reactor vessel 11) may be passed into the reactor 11 for recovery with catalytically-cracked products in the product line 20. Alternatively, the separated vaporous products from the cyclone separator 50 may be separately recovered, e.g., via olefin-recovery line 52 (shown in chain lines). The separate recovery of vaporous material from the transfer-line 41 may be advantageous in that olefins may be recovered therefrom in dedicated olefin-recovery equipment without adding to the duty of existing equipment for separating the vaporous products recovered in the product line 20. A further option is to pass some separated vaporous products from the transfer-line 41 directly to the reactor 11 and to recover the remainder separately via olefin-recovery line 52. Operationally, it may be expedient at a particular FCCU installation to adopt different options (from among those described) at different times for the handling and disposal of the vaporous products from the transfer-line 41.

Tests have been performed to investigate the effect of contacting iso-butane with a commercial equilibriated cracking catalyst containing rare earth, de-aluminated US-Y (ultra-stable Y) zeolite at conditions regarded as typical of those normally prevailing in the transfer-line 41 of FIGS. 2 and 3.

Figure 5:
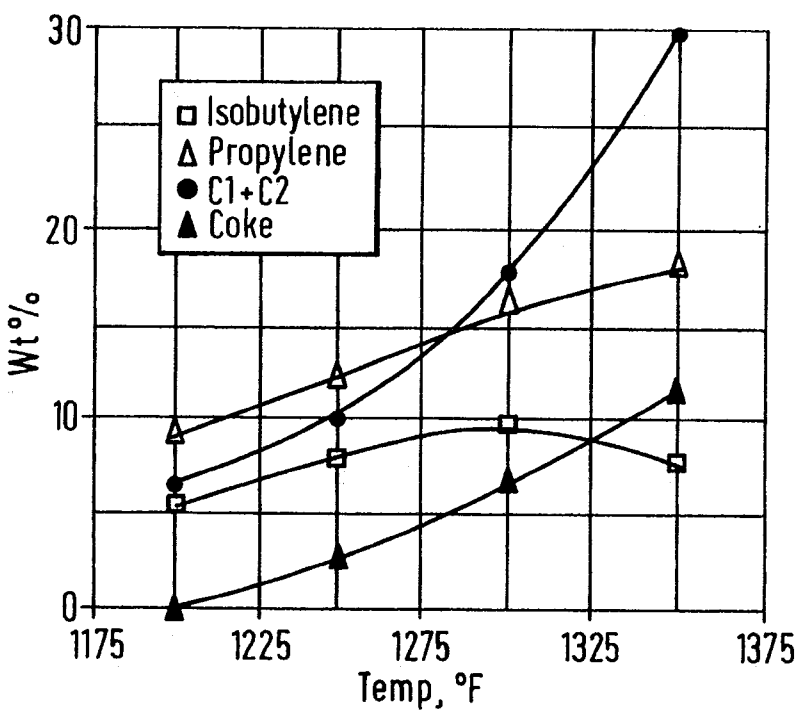
FIG. 5 is a graph showing the weight percentages of some conversion products over a range of temperatures resulting from the conversion of isobutane with the specified catalyst and under the same specified conversion conditions as in FIG. 4.
Figure 4:
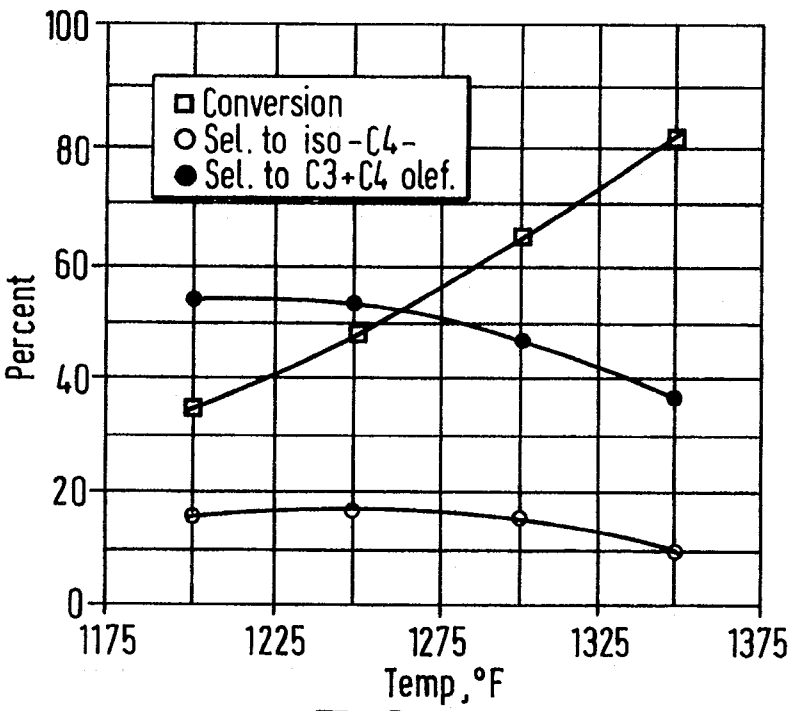
FIG. 4 is a graph showing the conversion and selectivities of conversion of isobutane over a range of temperatures using a specified catalyst under specified conversion conditions.

Table 1 provides a summary of the chemical and physical properties of the catalyst. FIGS. 4 and 5 of the drawings provide typical results of catalytic-cracking tests performed at a catalyst:oil ratio of 19.2:1 and a temperature range of 649°–732° C.

TABLE 1

| Properties of Commercial FCCU Equilibrium Catalyst Rare Earth, De-aluminated USY-zeolite-containing Catalyst | |
|---|---|
| Surface Area, $m^2/g$ | 149.1 |
| Pore Volume, $cm^3/g$ | 0.217 |
| Wt. % Carbon | 0.16 |
| Wt. % $SiO_2$ | 65.1 |
| Wt. % $Al_2O_3$ | 30.8 |
| Wt. % $Na_2O$ | 0.28 |
| Wt. % $RE_2O_3$ | 2.14 |
| wppm Nickel | 3270 |
| wppm Vanadium | 6230 |
| wppm Antimony | 400 |
| Unit Cell, A | 24.26 |

The catalyst was commercial cracking catalyst, as described in the previous paragraph, obtained from a residuum catalytic cracking process performed in a FCCU, and which had been treated with antimony to passivate nickel-contaminants.

Table 2 provides data demonstrating the benefits which are possible if a separate dehydrogenation-promoting catalyst (containing selected metals from Group 8) is contacted with isobutane at catalyst/oil weight ratio of 19.2:1 and a temperature of 732° C.

TABLE 2

| Cracking of Isobutane at 19.2:1 Catalyst/Oil Wt. Ratio and 732° C. (Dehydrogenation-promoting catalyst) | |
|---|---|
| Conversion Wt. % | 95.3 |
| Yields wt. % | |
| Coke | 10.4 |
| $C_1 + C_2$ | 17.1 |
| Propylene | 15.5 |
| Isobutylene | 43.9 |
| Selectivities Wt. % | |
| Isobutylene | 46.1 |
| $C_3 + C_4$ olefins | 63.6 |

Despite the presence of the nickel contaminants, it can be seen from FIGS. 4 and 5 that the catalyst was able to promote the conversion of isobutane to significant amounts of propene and butenes. The maximum actual yield of iso-butylene was obtained at about 704° C., but the amount of isobutane converted increases with increasing temperature. The selectivity for $C_3$ and $C_4$ olefins is between 35–55%, since coke and $C_1$ and $C_2$ gas production increase at a faster rate than $C_3$ and $C_4$ olefin production with increasing temperatures. Propylene production from isobutane is the result of cracking reactions and therefore propylene yields increase with temperature. By contrast, iso-butene production results from dehydrogenation of iso-butane and is therefore relatively slightly increased with temperature increases, the maximum conversion being attained under the test conditions employed at about 704° C. The degree of passivation of contaminant nickel can be regulated in the known manner by adding a nickel-passivator (such as antimony compound) to the catalyst. Alternatively or in addition, there may be added to the catalyst suitable active and selective dehydrogenation-promoting additives, such as small-pore zeolites and/or selected metals from Group 8. The test results for such additives show greater and more selective conversions of isobutane to isobutene (and propylene) with much reduced $C_1$ and $C_2$ gas production.

Another part of these investigations has suggested that the addition of hot regenerated catalyst to the stripper 22 to increase the stripper temperature by 30° C. reduce the total amount of coke which must be burned off in the regenerator 12 by about 5 weight percent. This can be regarded as a gratifying result since one cannot discount or overlook the possibility that some stripped hydrocarbon material can be adsorbed onto active adsorption sites on the hot regenerated catalyst.

In a variation of the embodiment shown in FIG. 2 of the drawings, at least some of the vapors produced by reactions in the transfer-line 41 are recovered therefrom upstream of the stripping zone 22, i.e. before they can enter the stripping zone 22. Those skilled in the art will understand, know and appreciate techniques and equipment for recovery of the said vapors. The recovered vapors are passed to one or more of the following:

(1) product recovery line 20 for passage to a fractionation column (not shown) of the type conventionally employed for the separation of cracked products from the FCCU into respective product streams;

(2) directly to the said fractionation column;

(3) directly to a product recovery facility specifically dedicated to recovering respective product streams from the vapors recovered from the transfer-line.

The techniques for implementing the foregoing are well-known, and will not therefore be described.

The invention is not confined to the illustrated and described embodiments. Moreover a feature or combination of features described in relation to one embodiment can be employed, if feasible, in another embodiment without departing from the scope of the invention as described and claimed in this patent specification.

What is claimed is:

1. In a catalytic cracking process comprising contacting a hydrocarbon feedstock in a reactor with particles of hot regenerated cracking catalyst under fluid catalytic cracking conditions to form vaporous cracked products and used catalyst particles having hydrocarbonaceous material and coke deposited thereon; stripping the used catalyst particles with a stripping fluid in a stripping zone to remove some hydrocarbonaceous material therefrom; recovering stripped hydrocarbonaceous material from the stripping zone and circulating stripped used catalyst particles to a regeneration zone; contacting stripped used catalyst particles in the regeneration zone with an oxygen-containing gas to remove unstripped hydrocarbonaceous material and coke therefrom by oxidation thereby raising the temperature of the catalyst particles; and circulating hot regenerated catalyst particles to the reactor for contact with further amounts of hydrocarbon feedstock; the improvement which comprises (a) separately circulating hot regenerated catalyst particles from the regenerator into the stripping zone whereby the hot regenerated particles mix with and raise the temperature of used catalyst particles in the stripping zone, (b) passing into contact with the separately circulating hot regenerated catalyst particles in step (a) a hydrocarbon-containing stream, said hydrocarbon-containing stream being contacted with the separately circulating hot regenerated particles before they enter the stripping zone and said hydrocarbon-containing stream containing an amount of hydrocarbon in excess of that required to effect aeration of the separately circulating hot regenerated catalyst and to combust all the oxygen present therewith so that the hydrocarbons are catalytically and thermally cracked into more desirable products and (c) recovering the cracked hydrocarbon products produced in step (b).

2. In the catalytic cracking process of claim 1, the improvement wherein the hydrocarbons in the hydrocarbon-containing stream in step (b) are selected from alkanes, cycloalkanes, alkenes, cycloalkenes and alkylaromatics and any combination of one or more of the said hydrocarbons.

3. In the catalytic cracking process of claim 1, the improvement wherein said hydrocarbon-containing stream of step (b) comprises a $C_4$ to $C_5$ olefin in combination with a hydrocarbon selected from the group consisting of alkanes, cycloalkanes, cycloalkenes, alkylaromatics and mixtures thereof.

4. In the process of claim 1, the improvement comprising passing a catalyst-conditioning gas and/or vapor stream into contact with the separately-circulating particles in step (a) before the separately-circulating particles are contacted with the hydrocarbon-containing stream, said catalyst conditioning stream containing a catalyst-conditioning agent selected from the group consisting of hydrogen, steam, methane, ammonia, nitrogen, an aromatic-containing stream, an amine-containing stream and a combination of at least two of the foregoing.

5. In the process of claim 1, the improvement comprising the step of separating vapor-phase materials from the regenerated catalyst particles passing to the stripper before the regenerated particles enter the stripper.

6. In the process of claim 5, the improvement wherein the separated vapor-phase materials are recovered separately.

7. In the process of claim 1, the improvement comprising incorporating a paraffins-dehydrogenation component in or with the cracking catalyst to promote or enhance the dehydrogenation of paraffinic hydrocarbons in the said hydrocarbon-containing stream.

8. In a catalytic cracking process comprising contacting a hydrocarbon feedstock in a reactor with particles of hot regenerated cracking catalyst under fluid catalytic cracking conditions to form vaporous cracked products and used catalyst particles having hydrocarbonaceous material and coke deposited thereon; stripping the used catalyst particles with a stripping fluid in a stripping zone to remove some hydrocarbonaceous material therefrom; recovering stripped hydrocarbonaceous material from the stripping zone and circulating stripped used catalyst particles to a regeneration zone; contacting stripped used catalyst particles in the regeneration zone with an oxygen-containing gas to remove unstripped hydrocarbonaceous material and coke therefrom by oxidation thereby raising the temperature of the catalyst particles; and circulating hot regenerated catalyst particles to the reactor for contact with further amounts of hydrocarbon feedstock; the improvement which comprises (a) separately circulating hot regenerated catalyst particles from the regenerator into the stripping zone whereby the hot regenerated particles mix with and raise the temperature of used catalyst particles in the stripping zone, (b) passing into contact with the separately circulating hot regenerated catalyst particles in step (a) a hydrocarbon-containing stream, said hydrocarbon-containing stream being contacted with the separately circulating hot regenerated particles before they enter the stripping zone and said hydrocarbon-containing stream containing an amount of hydrocarbon in excess of that required to effect aeration of the separately circulating hot regenerated catalyst and to combust all the oxygen present therewith so that the hydrocarbons are catalytically and thermally cracked into more desirable products and (c) separating the cracked hydrocarbon products from the regenerated catalyst particles passing to the stripper before the regenerated particles enter the stripper.

* * * * *